US010923806B2

(12) United States Patent
Hall et al.

(10) Patent No.: US 10,923,806 B2
(45) Date of Patent: Feb. 16, 2021

(54) BROADBAND HELICAL MICROSTRIP ANTENNA

(71) Applicants: David R. Hall, Provo, UT (US); Mark Hall, Springville, UT (US); Craig Boswell, Draper, UT (US); Bill Gillman, Salt Lake City, UT (US)

(72) Inventors: David R. Hall, Provo, UT (US); Mark Hall, Springville, UT (US); Craig Boswell, Draper, UT (US); Bill Gillman, Salt Lake City, UT (US)

(73) Assignee: Hall Labs LLC, Provo, UT (US)

( * ) Notice: Subject to any disclaimer, the term of this patent is extended or adjusted under 35 U.S.C. 154(b) by 300 days.

(21) Appl. No.: 15/391,071

(22) Filed: Dec. 27, 2016

(65) Prior Publication Data

US 2018/0183143 A1 Jun. 28, 2018

(51) Int. Cl.

*H01Q 1/36* (2006.01)
*H01Q 1/38* (2006.01)
*H01Q 11/08* (2006.01)

(52) U.S. Cl.

CPC ..... *H01Q 1/362* (2013.01); *H01Q 1/38* (2013.01); *H01Q 11/08* (2013.01)

(58) Field of Classification Search

CPC ..... H01Q 11/08; H01Q 1/362; H01Q 9/0421; H01Q 1/38; H01Q 9/0414; H01Q 9/44; H01Q 9/40; H01Q 9/27; H01Q 1/36; H01Q 9/065; H01Q 9/16

USPC ..... 343/895, 843, 866, 896

See application file for complete search history.

(56) References Cited

U.S. PATENT DOCUMENTS

2006/0256031 A1* 11/2006 Bae ..... H01Q 11/08 343/895
2008/0303743 A1* 12/2008 Park ..... H01Q 1/362 343/895
2008/0309572 A1* 12/2008 Parsche ..... H01Q 1/36 343/795
2009/0128437 A1* 5/2009 Sonoda ..... H01Q 7/06 343/788
2012/0229342 A1* 9/2012 Maeda ..... H01Q 1/36 343/700 MS

* cited by examiner

*Primary Examiner* — Ricardo I Magallanes

(57) ABSTRACT

A broadband helical microstrip antenna having a small foot print is disclosed. A PCB (printed circuit board) has a first planar side opposite a second planar side with dielectric material therebetween. The first planar side comprising a plurality of spaced apart non-linear antenna segments, each non-linear antenna segment having one or more electrical vias to the second planar side of the printed circuit board. The second planar side comprising a plurality of spaced apart parallel linear antenna segments. The plurality of non-linear antenna segments and the plurality of linear antenna segments form the broadband helical microstrip antenna symmetrical about a center line formed by a centered linear antenna segment of the plurality of spaced apart parallel linear antenna segments of the second planar side.

18 Claims, 7 Drawing Sheets

BROADBAND HELICAL MICROSTRIP ANTENNA

BACKGROUND

Field of the Invention

The present invention is related to specific structure of a broadband microstrip antenna.

SUMMARY

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

In some instances, features represented by numerical values, such as dimensions, mass, quantities, and other properties that can be represented numerically, are stated as approximations. Unless otherwise stated, an approximate value means "correct to within 50% of the stated value." Thus, a length of approximately 1 inch should be read "1 inch+/−0.5 inch."

Aspects of the present invention are described herein with reference to flowchart illustrations and/or block diagrams of methods, apparatus (systems), and computer program products according to embodiments of the invention. Those of skill in the art will understand that each block of the flowchart illustrations and/or block diagrams, and combinations of blocks in the flowchart illustrations and/or block diagrams, may be implemented by computer readable program instructions. Additionally, those of skill in the art will recognize that the system blocks and method flowcharts, though depicted in a certain order, may be organized in a different order and/or configuration without departing from the substance of the claimed invention.

This invention has been developed in response to the present state of the art and, in particular, in response to the problems and needs in the art that have not yet been fully solved by currently available systems and methods. Accordingly, a broadband helical microstrip antenna with a small footprint has been developed. Features and advantages of different embodiments of the invention will become more fully apparent from the following description and appended claims, or may be learned by practice of the invention as set forth hereinafter.

A broadband helical microstrip antenna having a small foot print is formed on a printed circuit board (PCB). The PCB having a first planar side opposite a second planar side with dielectric material therebetween. The first planar side comprising a plurality of spaced apart non-linear antenna segments, each non-linear antenna segment having one or more electrical vias to the second planar side of the printed circuit board. The second planar side comprising a plurality of spaced apart parallel linear antenna segments. The plurality of non-linear antenna segments and the plurality of linear antenna segments form the broadband helical microstrip antenna symmetrical about a center line formed by a centered linear antenna segment of the plurality of spaced apart parallel linear antenna segments of the second planar side. The centered linear antenna segment being more than twice as long as any remaining parallel linear antenna segments of the plurality of spaced apart parallel linear antenna segments. The remaining parallel linear antenna segments (not the single centered segment) may all be of equal size and shape. The plurality of non-linear antenna segments may each overlap at least a portion of one or more of the plurality of spaced apart parallel linear antenna segments to cooperatively form helical portions the broadband helical microstrip antenna. The broadband helical microstrip antenna may have a physical width between 10 mm and 35 mm. The broadband helical microstrip antenna may have a physical length between 10 mm and 35 mm. The broadband helical microstrip antenna may have a physical width and a physical length both between 10 mm and 35 mm. The broadband helical microstrip antenna may operate at transmit and receive frequencies between 902 MHz and 928 MHz inclusive. The plurality of spaced apart non-linear antenna segments may comprise at least 15 spaced apart non-linear segments. The plurality of spaced apart parallel linear antenna segments may comprise at least 16 spaced apart parallel linear antenna segments. The at least 16 spaced apart parallel linear antenna segments may all have an equal length and an equal width. The at least 16 spaced apart parallel linear antenna segments may each have 2 through hole vias connecting to the first planar side. Each the at least 15 spaced apart non-linear antenna segments may have an angled top section and an angled bottom section. Each of the angled top sections may form a first interior angle and each of the angled bottom sections may form a second interior angle. Any one of the first interior angles and any one of the second interior angles may be supplementary angles. Each of the at least 16 spaced apart parallel linear antenna segments may have a length between 4 mm and 8 mm. The first planar side may include an antenna ground plane. The centered linear antenna segment may be a radiating element of the broadband helical microstrip antenna. The broadband helical microstrip antenna may be powered by a feed point at an end of the centered linear antenna segment. Electronics for driving the broadband helical microstrip antenna may be located on the first planar side. The one or more electrical vias may be plated through hole vias which are not solder filled.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention.

Figure 1:
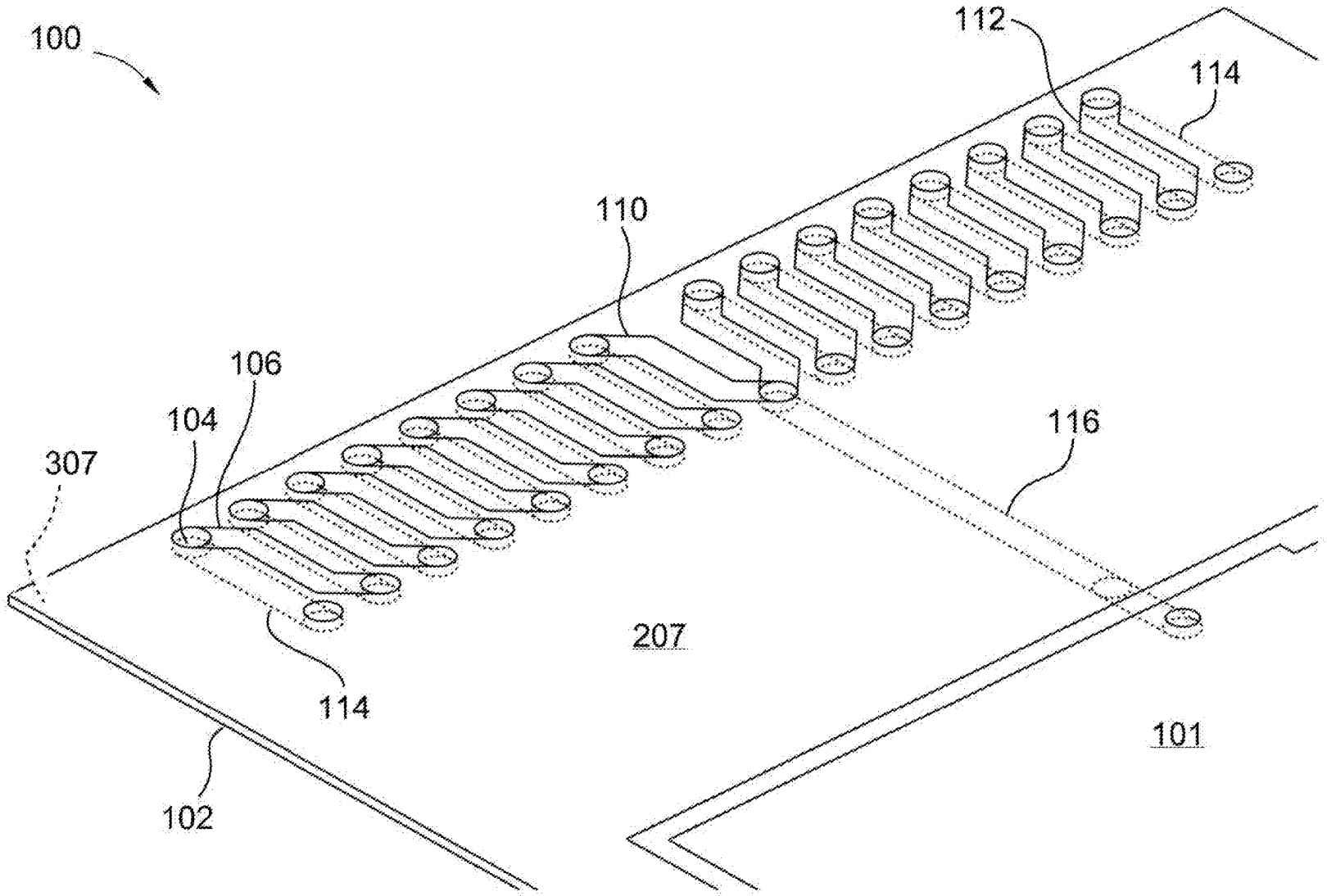
FIG. 1 shows a partially transparent skewed view of a broadband helical microstrip antenna in accordance with the invention.

FIG. 1 shows a partially transparent skewed view 100 of a broadband helical microstrip antenna in accordance with the invention. A first planar side 207 of PCB (printed circuit board) 102 contains a first grouping of seven identical spaced apart non-linear antenna segments 106, a "V" shaped non-linear center segment 110, a second grouping of seven identical spaced apart non-linear antenna segments 112, a ground plane 101, and more than thirty electrical through hole vias 104. A second planar side 307 of PCB 102 contains fourteen identical spaced apart parallel antenna segments 114 and a centered linear antenna segment 116. Antenna segment 116 is a radiating element of antenna 100 and parallel to the other fourteen parallel antenna segments 114. Antenna segment 116 is more than twice the length of any linear parallel antenna segment 114. Electrical vias 104 may be plated through hole vias without solder filling the holes of the vias.

Figure 2:
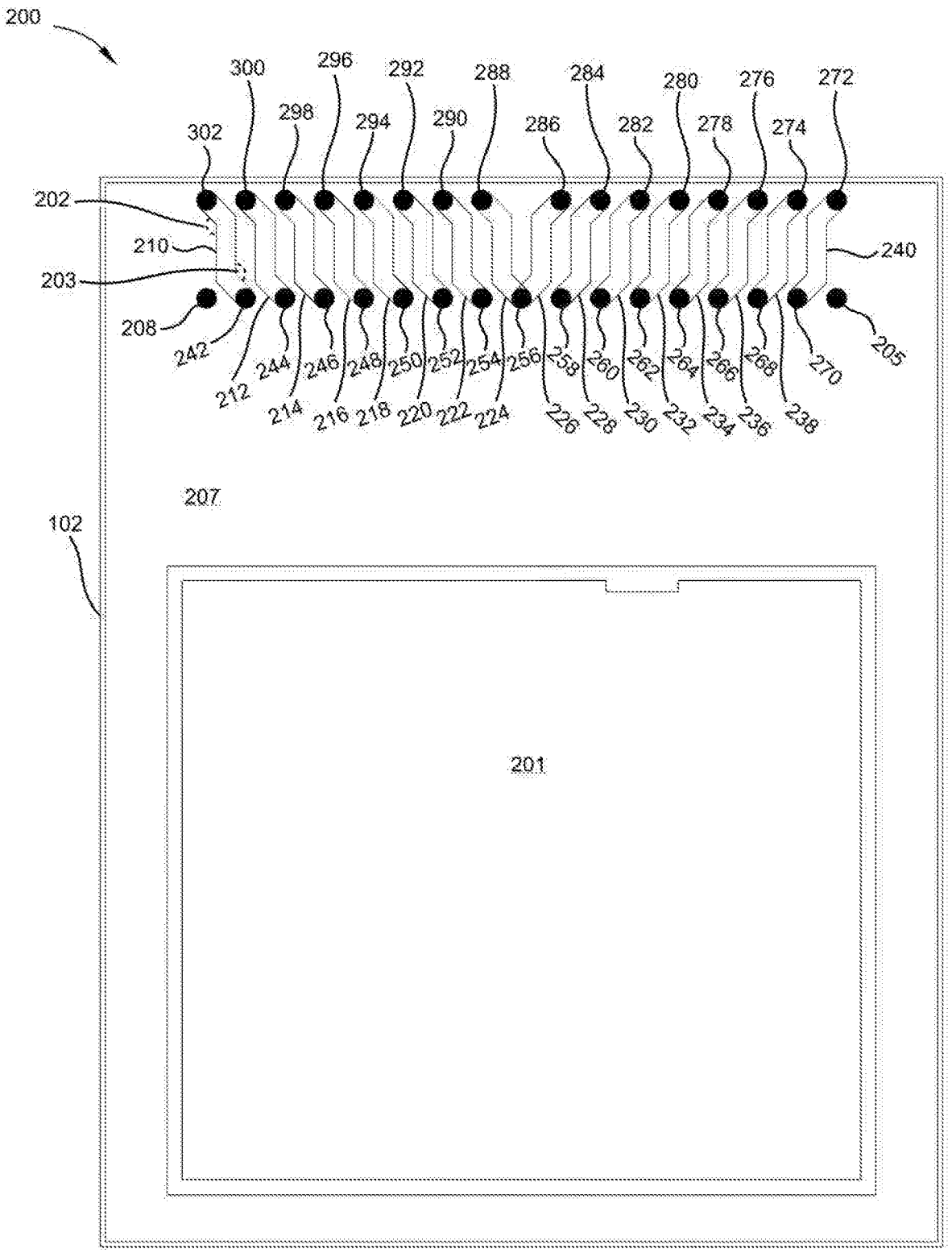
FIG. 2 shows a top view of a first side of a PCB of a broadband helical microstrip antenna in accordance with the invention.

FIG. 2 shows a top view 200 of a first side 207 of a PCB 102 of a broadband helical microstrip antenna in accordance with the invention. First side 207 includes non-linear antenna segments 210-222 and 228-240. Each non-linear antenna segment 210-222 and 228-240 is comprised of angled top sections 272-302 and angled bottom sections 242-270. Each of the angled top sections 272-302 form a first interior angle 202 and each of the angled bottom sections form a second interior angle 203. Angles 202 and 203 of each segment 210-222 and 228-240 are supplementary, the angles add to 180 degrees. An additional non-linear segment may be formed by a "V" shaped middle segment 224 and 226. Via 256 of the middle segment 224/226 connects to a long linear parallel segment on the second planar side of PCB 102. Symmetry or a mirror image is formed on each side of middle segment 224/226 by the other segments 210-222 and 228-240. Angled top sections 272-302 and angled bottom sections 242-270 may have one or more vias connecting the angled sections to parallel linear sections on the second planar side of PCB 102. Antenna segments 210-222 and 228-240 each may have one or more electrical vias that connect to corresponding segments on the second planar side of PCB 102. Antenna ground plane 201 may be located on the first planar side 207 of PCB 102. Electronic driving, encoding/decoding, and processing circuitry may also be co-located with ground plane 201 to drive signals out of the broadband helical microstrip antenna and process signals received from the broadband helical microstrip antenna and/or may be located on the second planar side of PCB 102.

Figure 3:
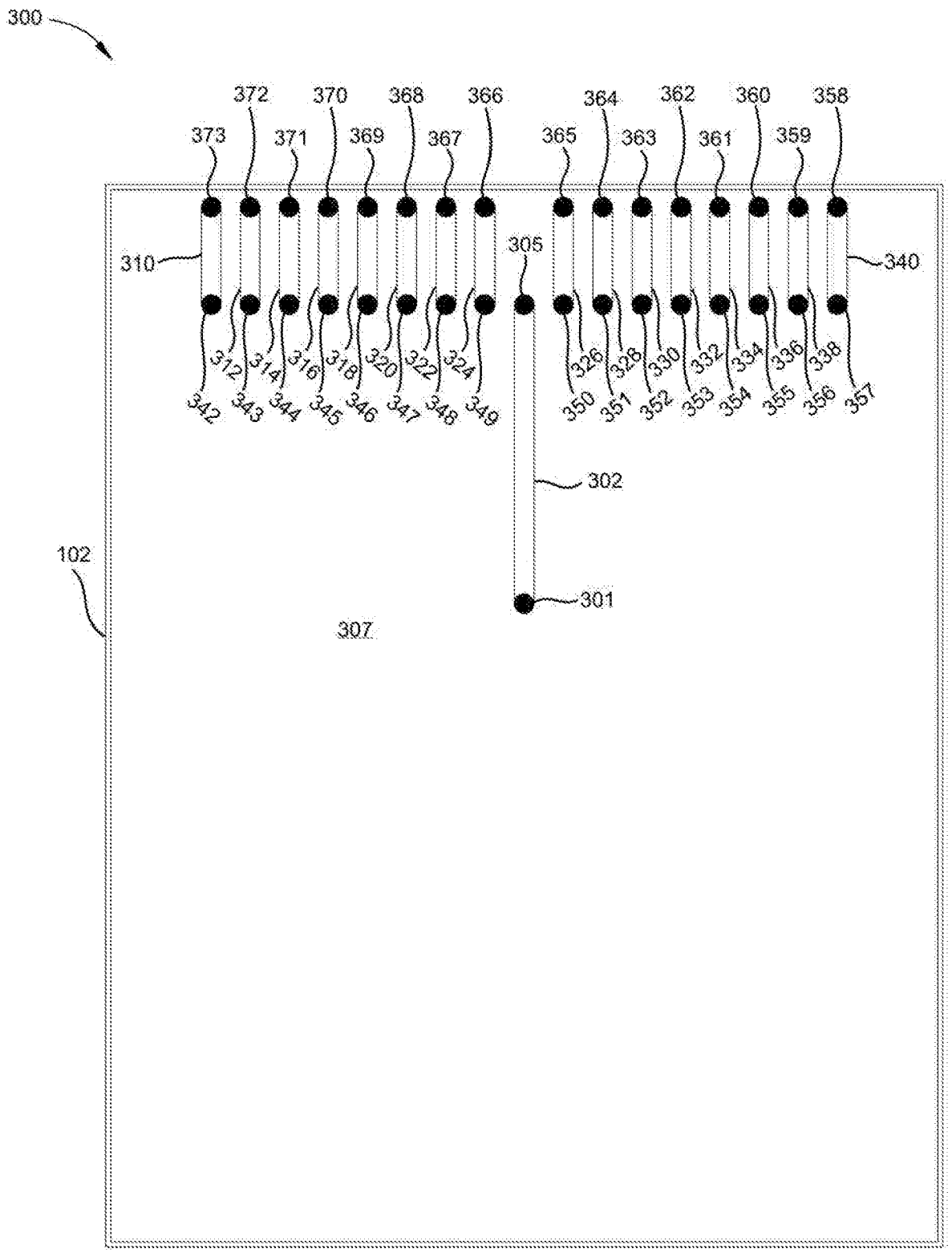
FIG. 3 shows a top view of a second side of a PCB of a broadband helical microstrip antenna in accordance with the invention.

FIG. 3 shows a top view 300 of a second side 307 of PCB 102 of a broadband helical microstrip antenna in accordance with the invention. Second side 307 includes sixteen identical parallel linear antenna segments 310-324 and 326-340, a long parallel linear antenna segment 302, and vias 342-373 and 305. Long parallel linear antenna segment 302 forms a line of symmetry where mirror images of the antenna are found on each side of a center lined formed by segment 302. Long parallel linear antenna segment 302 is more than twice or two times as long as any one parallel linear antenna segment 310-324 and 326-340. All antenna segments on planar side one and planar side two may be formed by etching copper in a standard circuit board etching process. Feed point 301 may be located on an end of linear antenna segment 302. The opposite end of linear antenna segment 302 may contain a via 305 to the first planar side and electrically connect to the centered "V" shaped non-linear antenna segment 256. Likewise, vias 342-373 electrically connect to non-linear antenna segments of the first planar side to cooperatively form a helical antenna.

Figure 4:
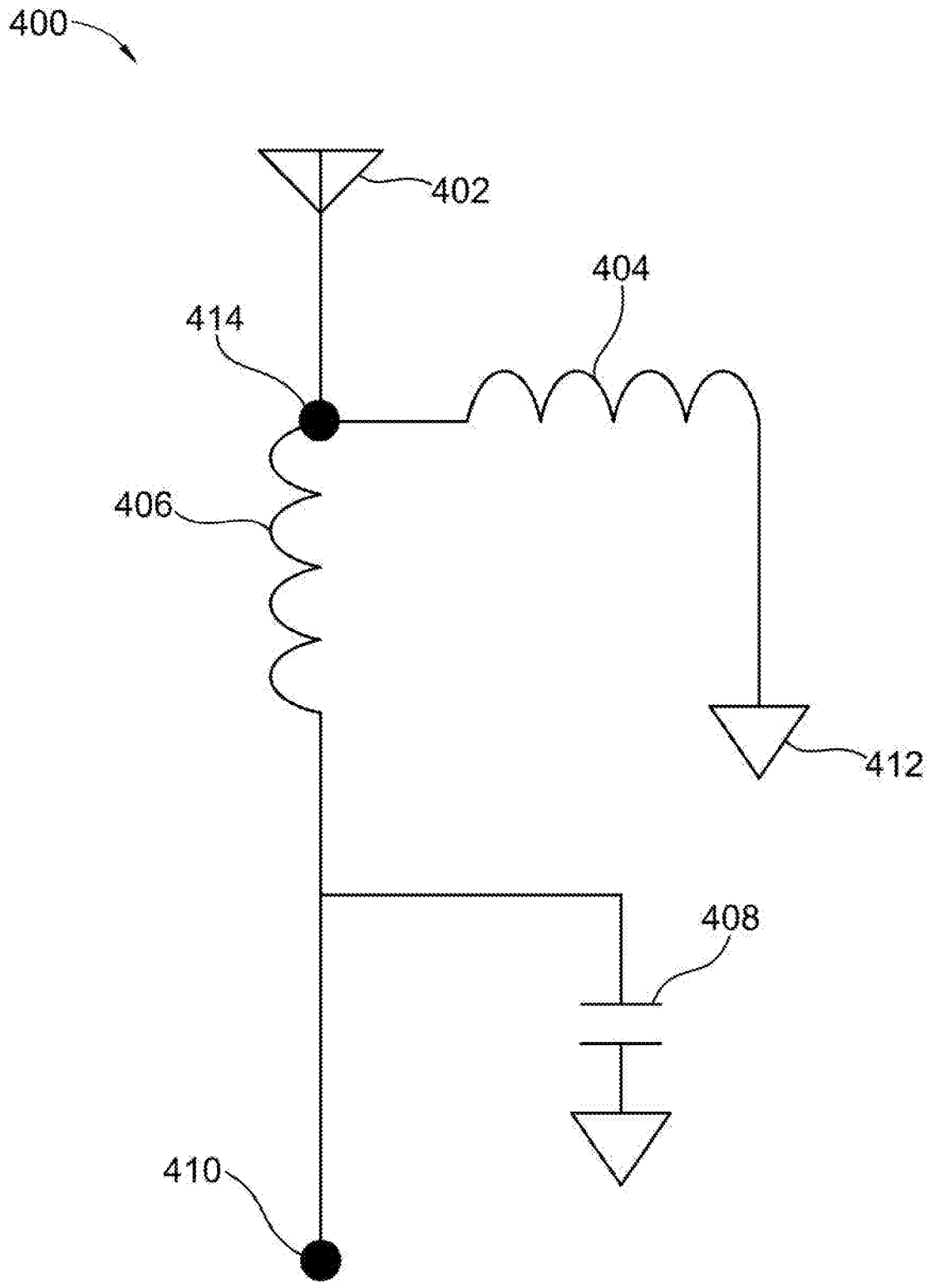
FIG. 4 shows an electrical schematic of a matching circuit of a broadband helical microstrip antenna in accordance with the invention.

FIG. 4 shows an electrical schematic 400 of a matching circuit of a broadband helical microstrip antenna in accordance with the invention. Node 414 corresponds with feedpoint 301 of FIG. 3. Node 414 is where the antenna structure as shown in FIGS. 2 and 3 is powered. Inductors 406, 404 and capacitor 408 form a matching network to impedance match the broadband helical microstrip antenna between the modulation source, the physical characteristics of the antenna and free space. Various matching networks are possible and are well known in the art. Node 410 connects to a modulation driver chip or other driving circuitry to power the antenna.

Figure 5:
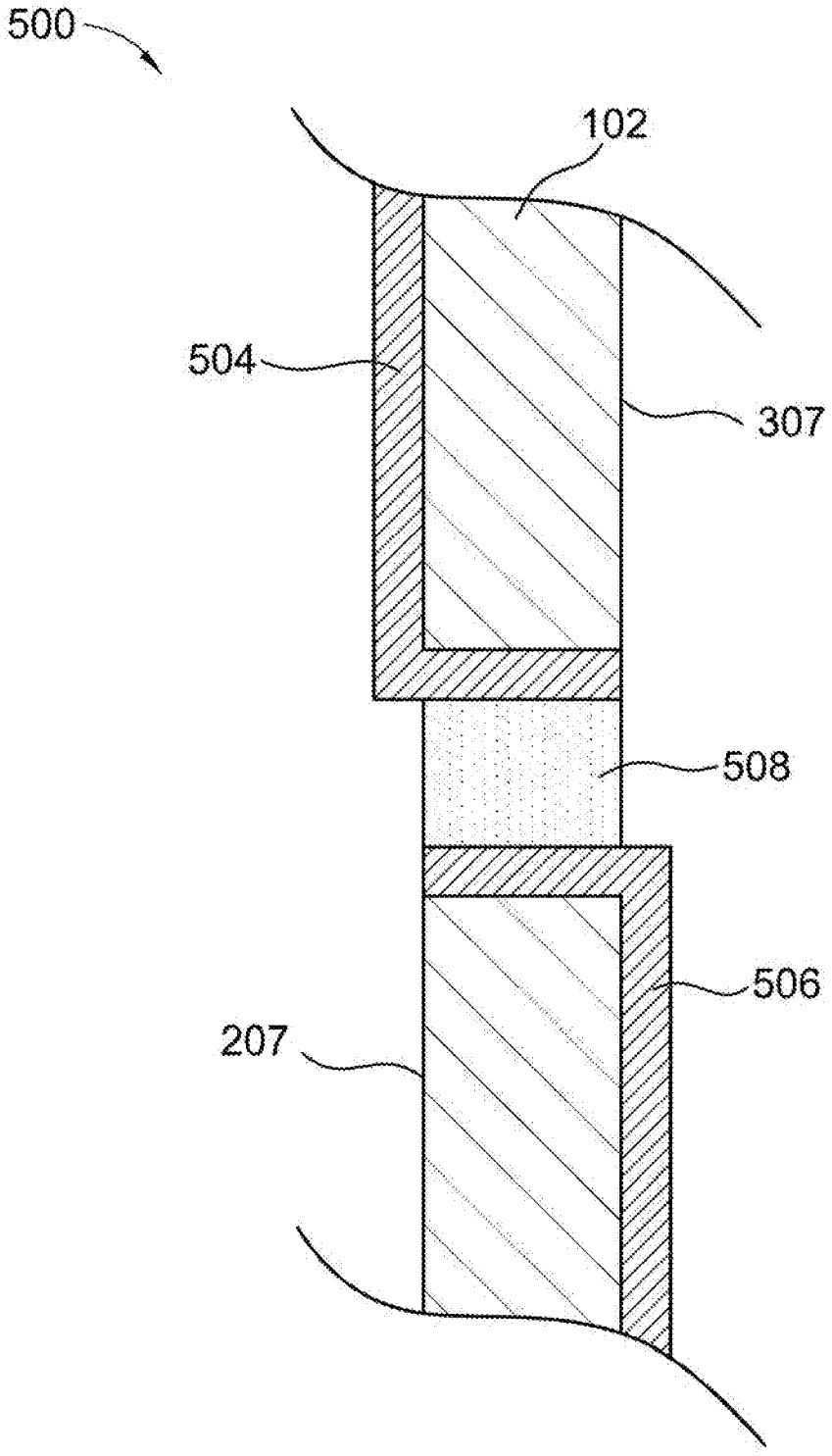
FIG. 5 shows a side cross section of a PCB of a broadband helical microstrip antenna in accordance with the invention.

FIG. 5 shows a side cross section 500 of PCB 102 of a broadband helical microstrip antenna in accordance with the invention. PCB 102 includes a first planar side 207 and a second planar side 307. First planar side 207 and second planar side 307 contain antenna segments 5043 and 506 connected by via 508. Via 508 may be a plated through hole that electrically connects antenna segments 504 and 506 together. Antenna segments 504 and 506 may be circuit board traces etched out of copper.

Figure 6:
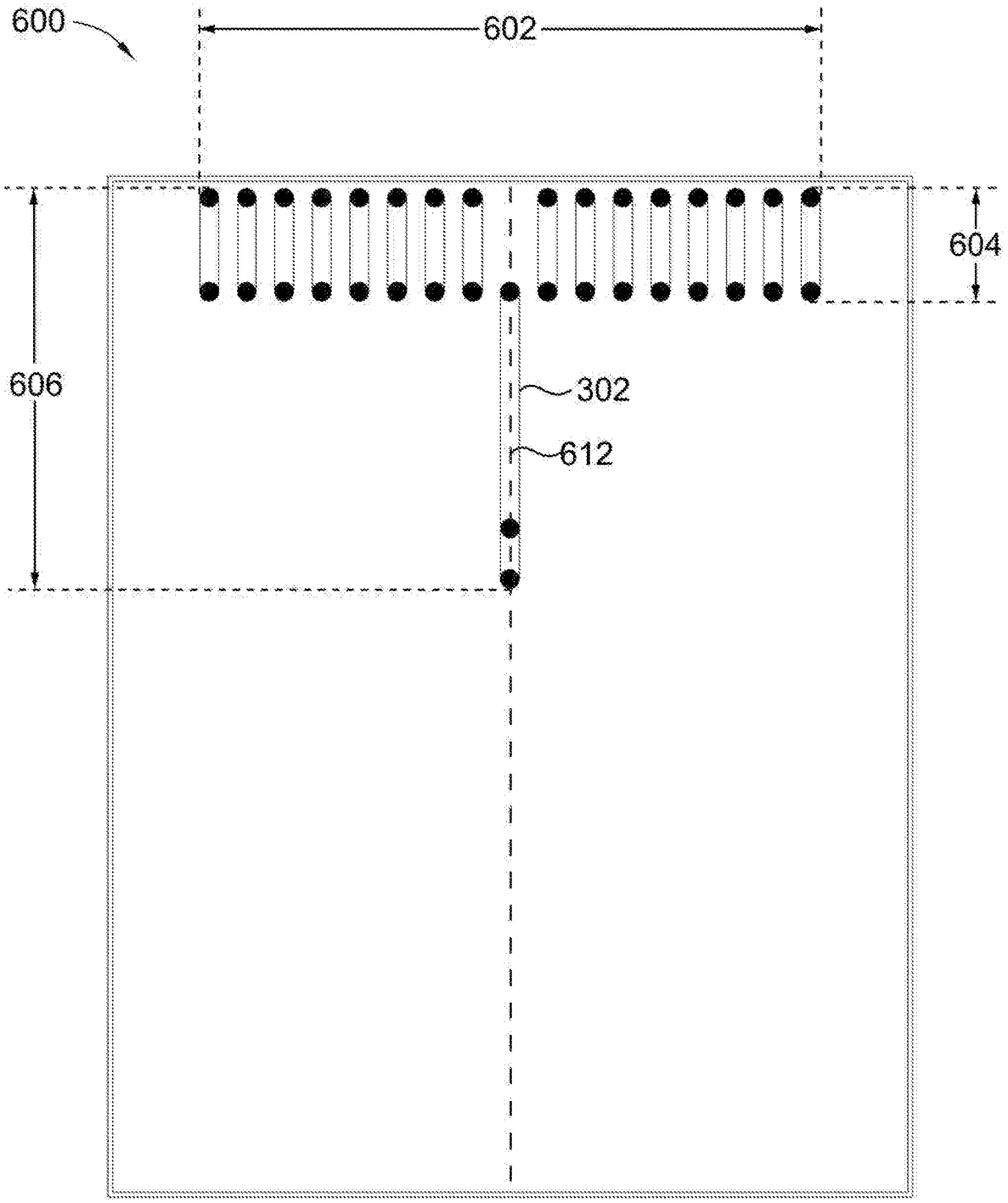
FIG. 6 shows a top view of a second side of a PCB of a broadband helical microstrip antenna in accordance with the invention.

FIG. 6 shows a top view 600 of a second side of a PCB of a broadband helical microstrip antenna in accordance with the invention. An overall antenna width 602 may be between 15 mm and 40 mm. An overall antenna length 606 may be between 15 mm and 40 mm. An overall antenna width 602 and length may be between 15 mm and 40 mm. Long parallel linear radiating element 302 may have a length between 12 mm and 18 mm and a width between 0.5 mm and 1.5 mm. Center line of symmetry 612 may be formed by taking a middle point of long antenna element 302. A mirror image of antenna elements is obtained on each side of the PCB about the center line of symmetry 612. Parallel linear antenna segments may have a length 604 between 4 mm and 8 mm.

Figure 7:
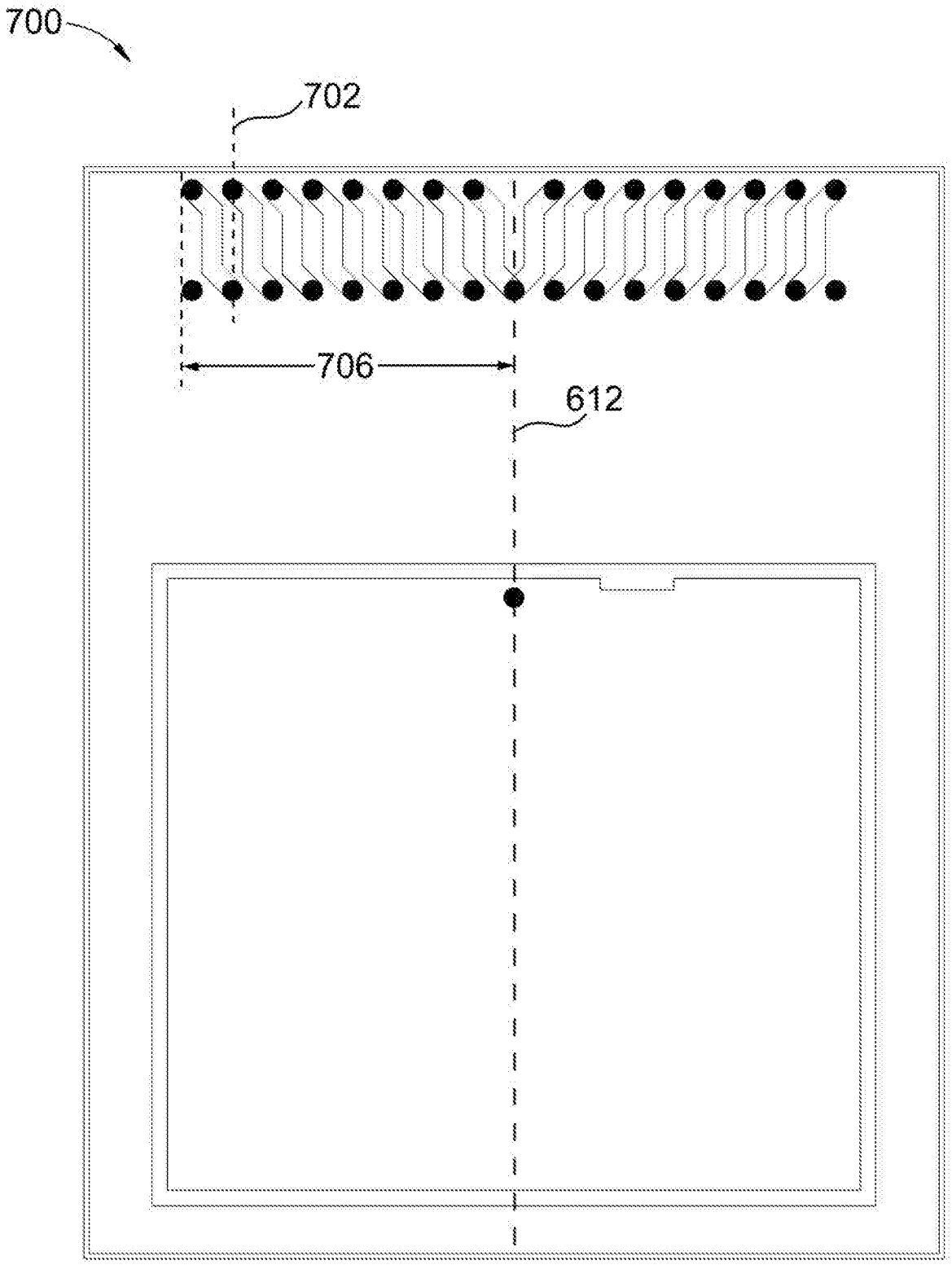
FIG. 7 shows a top view of a first side of a PCB of a broadband helical microstrip antenna in accordance with the invention.

FIG. 7 shows a top view 700 of a first side of a PCB of a broadband helical microstrip antenna in accordance with the invention. First planar side of the PCB has the same center line of symmetry 612 as does the second planar side of the PCB. Identical features and sizes are found on each of line 612. Width 706 is exactly half of width 602 from the second planar side. Vertical alignment 702 forms a line where the linear parallel elements of the second planar side align to complete the helical antenna formation.

The systems and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A broadband helical microstrip antenna comprising:

a printed circuit board having a first planar side opposite a second planar side with dielectric material therebetween;

a first array of spaced apart parallel antenna segments on the first planar side, each of the antenna segments in the first array having one or two electrical vias to the second planar side;

a second array of spaced apart parallel antenna segments on the second planar side, each of the antenna segments in the second array being connected to one or two of the antenna segments in the first array by one or two electrical vias, thereby forming at least one helical path;

a linear antenna segment disposed along a center line of the second planar side, the linear antenna segment being more than twice as long as any of the antenna segments in the first and second array, and the linear antenna segment connected to one or two of the antenna segments in the first or second array;

wherein the first and second arrays are generally parallel to each other and wherein the first and second arrays are arranged with an equal number of antenna segments on both sides of the linear antenna segment.

2. The antenna of claim 1, wherein the antenna segments in the first array are all of equal size and shape.

3. The antenna of claim 1, wherein the antenna segments in the second array are all of equal size and shape.

4. The antenna of claim 1, wherein the first and second array both have the same number of antenna segments, and wherein the number is an even number.

5. The antenna of claim 1, wherein the linear antenna segment is connected to two antenna segments in the first array, which two antenna segments are closest to the center line.

6. The antenna of claim 5, wherein the two antenna segments to which the linear antenna segment is attached are each the beginning of a helical path on each side of the center line.

7. The antenna of claim 6, wherein each of the antenna segments in the first array have two electrical vias, one electrical via at each end.

8. The antenna of claim 1, wherein the broadband helical microstrip antenna has a physical width and a physical length both between 15 mm and 40 mm.

9. The antenna of claim 8, wherein the broadband helical microstrip antenna operates at transmit and receive frequencies between 902 MHz and 928 MHz.

10. The antenna of claim 1, wherein the first array and the second array each comprise at least 14 spaced apart antenna segments.

11. The antenna of claim 1, wherein each the antenna segments in the first array have an angled top section and an angled bottom section.

12. The antenna of claim 11, wherein each of the angled top sections form a first interior angle and each of the angled bottom sections form a second interior angle and all of the first interior angles and second interior angles are supplementary angles.

13. The antenna of claim 1, wherein each of the antenna segments in the first and second arrays have a length between 4 mm and 8 mm.

14. The antenna of claim 1, wherein the first planar side includes an antenna ground plane.

15. The antenna of claim 1, wherein the linear antenna segment is a radiating element of the broadband helical microstrip antenna.

16. The antenna of claim 15, wherein the broadband helical microstrip antenna is powered by a feed point at an end of the linear antenna segment.

17. The antenna of claim 16, wherein electronics for driving the broadband helical microstrip antenna are located on the first planar side.

18. The antenna of claim 1, wherein the electrical vias are plated through hole vias which are not solder filled.

* * * * *